US005551200A

United States Patent [19]

Krug

[11] Patent Number: 5,551,200

[45] Date of Patent: Sep. 3, 1996

[54] ELONGATED INTEGRAL TRUSS BRACE

[76] Inventor: Eugene E. Krug, 11741 Rolling Pine La., Port Richey, Fla. 34668

[21] Appl. No.: 377,468

[22] Filed: Jan. 24, 1995

[51] Int. Cl.[6] ..... E04C 5/18; E04C 3/02; E04B 1/38; E04H 12/10

[52] U.S. Cl. ..... 52/696; 52/643; 52/690; 52/714

[58] Field of Search ..... 52/317, 643, 665, 52/666, 690, 696, 712, 714, 730.1, 92.2

[56] References Cited

U.S. PATENT DOCUMENTS

| | | | |
|---|---|---|---|
| 2,108,107 | 2/1938 | Wees | 52/714 |
| 3,010,162 | 11/1961 | Klein | 52/696 |
| 3,225,394 | 12/1965 | Tillisch et al. | 52/714 |

*Primary Examiner*—Carl D. Friedman
*Assistant Examiner*—Yvonne Horton-Richardson
*Attorney, Agent, or Firm*—A. W. Fisher, III

[57] ABSTRACT

An elongated integral truss brace to operatively engage opposite end portions of each of a plurality of lower truss tie bars of a corresponding plurality of roof trusses to retain the plurality of lower truss tie bars and corresponding roof trusses in space relationship relative to each other to reinforce the roof truss system formed by the plurality of roof trusses, the elongated integral truss brace comprising a pair of substantially parallel lower interrupted side panels held in fixed spaced relationship relative to each other by an upper elongated interconnecting member to cooperatively form a stiffener channel therebetween to receive and retain a plurality of rigid brace stiffeners therein and forming a tie bar slot between adjacent rigid brace stiffeners to receive end portions of the lower truss tie bars.

25 Claims, 3 Drawing Sheets

ELONGATED INTEGRAL TRUSS BRACE

BACKGROUND OF THE INVENTION

1. Field of the Invention

An elongated integral truss brace to operatively engage opposite end portions of each of a plurality of lower truss tie bars to reinforce the roof truss system formed by a plurality of roof trusses.

2. Description of the Prior Art

In the construction industry, there has been an entire business centered around the production of prefabricated roof trusses. Typically such prefabricated trusses comprise an elongated tie bar or stringer having a strut or king post extending upwardly from the midportion thereof and a rafter extending diagonally downward from the upper end portion of the strut or king post to each outer end portion of the elongated tie bar or stringer. New building codes require that such prefabricated trusses be reinforced (braced) once installed.

Heretofore, the reinforcement of such trusses required the workman to cut 2×4s, 2×6s or 2×8s the length of the distance between trusses on site. Not only is this practice time consuming, but considerable waste material accumulates from the ends of the 2×4s, 2×6s or 2×8s too short to be used.

U.S. Pat. No. 3,206,903 describes structures assembled with two methods, conventional and prefabricated. Conventional building structures have the advantage of flexibility and design, but have high labor costs. Prefabrication has the advantage of lower field cost and shorter construction time, but at the expense of flexibility in materials and design. In actual practice, conventional and prefab construction at low market prices means sacrificing quality of materials, areas of space and insulation values of soundness of frame.

U.S. Pat. No. 1,261,173 shows a roof truss comprising a strut or king post, the bottom of which rests upon the tie beam or stringer and the top of which is secured to the rafters. The end of the king post lies below the top of the rafters and the rafters are nailed to the side of the king post at the ridge of the truss and to the side of the tie beams or stringers at the eaves of the truss so as to form a groove between them. The tie beam is notched so as to cooperate with the notch in the wall plate member. The wide part of the notch receives the pairs of rafters. Instead of employing two rafters on each side of the truss, a single wide rafter with a suitable groove therein might be provided to perform the same function. The groove which is formed between the rafters is of a width suitable to receive the rails of adjacent roof sections.

U.S. Pat. No. 1,277,766 describes a portable building construction comprising a roof truss constructed of rafters of substantially uniform depth and wall plates upon which the rafters rest. The lower ends of the rafters project beyond the wall plates to form an eave. A tie beam connects the rafters. The ends provide shoulders to abut the inner sides of the wall plates that include inclined bottomed notches to receive the rafters in uncut condition.

U.S. Pat. No. 3,421,270 shows a prefabricated roof including a series of spaced beams and a ridge pole extending therebetween. The beams include upper surfaces inclined upwardly to a peak location at which the beams are recessed beneath the planes of the inclined surfaces to receive the ridge pole essentially beneath those planes. The ridge pole may have spaced markings at which it is to be connected to the beams to facilitate accurate spacing of the beams during assembly.

U.S. Pat. No. 3,206,903 teaches a modular framing for buildings comprising precision factory precut and notched components for quick interfitting and erection on a building site. The components include a base plate of a predetermined length having equidistantly spaced notched seats on its upper face, a top plate of a predetermined length having equidistantly spaced notches in its upper and lower faces with the notches in direct vertical alignment with the notches in the base plate, a plurality of studs having their upper ends slotted and interfitted in the notches in he lower face of the top plate and their lower ends fitted in the notches in the base plate, roof rafters supported by the top plate having their lower ends notched and interfitted in the notches in the upper face of the top plate, a ridge beam including a central beam member and outer side board members secured to the central beam member and projecting above the upper edge thereof, the upper edges of the side board members being notched substantially down to the central beam member, the inner ends of the rafters being fitted in the notches in the side board members.

U.S. Pat. No. 1,261,173 describes a sliding panel comprising a top, a bottom and an intermediate rail. The ends of each of the rails are notched; while, a sill member includes a groove to receive the bottom rail. A plurality of studs are notched to receive the notched ends of the rails of the siding panel with the studs overlapping the edges of adjacent panels and bolts passing through the studs and holding the adjacent panels thereto.

U.S. Pat. No. 324,456 shows a portable building including rafters provided with notches, a notched strip and vertically arranged projections on the plate, all being constructed and arranged substantially as set forth. Norwegian patent 77,860 teaches the use of notches in truss braces.

SUMMARY OF THE INVENTION

The present invention relates to an elongated integral truss brace comprising a truss brace frame and a brace stiffener to operatively engage opposite end portions of each of a plurality of lower truss tie bars of a corresponding plurality of roof trusses to retain the plurality of lower truss tie bars and corresponding roof trusses in space relationship relative to each other to reinforce the roof truss system formed by the plurality of roof trusses (not shown). Each elongated integral truss brace comprises a pair of substantially parallel lower interrupted side panels held in fixed spaced relationship relative to each other by an upper elongated interconnecting member to cooperatively form a stiffener channel therebetween to receive and retain a plurality of rigid brace stiffeners, such as 2×4 or 2×6 wood fillers therein.

Each lower interrupted side panel comprises a plurality of spaced apart side panel sections. A tie bar slot is formed between adjacent rigid brace stiffeners to receive opposite end portions of the lower truss tie bar.

The upper elongated interconnecting member comprises a pair of elongated side plates interconnected to each other by an elongated center connecting element.

To assemble, the rigid brace stiffeners are placed in the stiffener channel and secured in place by nails, glue or similar securing means thereby forming the plurality of tie bar slots.

To use, an assembled elongated integral truss brace comprising the truss brace frame including the lower interrupted side panel and the upper elongated interconnecting member and the brace stiffener including the plurality of rigid brace stiffeners is operatively positioned on opposite end portions of the lower truss tie bars by placing the lower truss tie bars in corresponding tie bar slots. The elongated integrated truss brace is then secured to the lower truss tie bars by nails or other suitable securing means to brace and reinforce the plurality of roof trusses of the roof truss system.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 2:
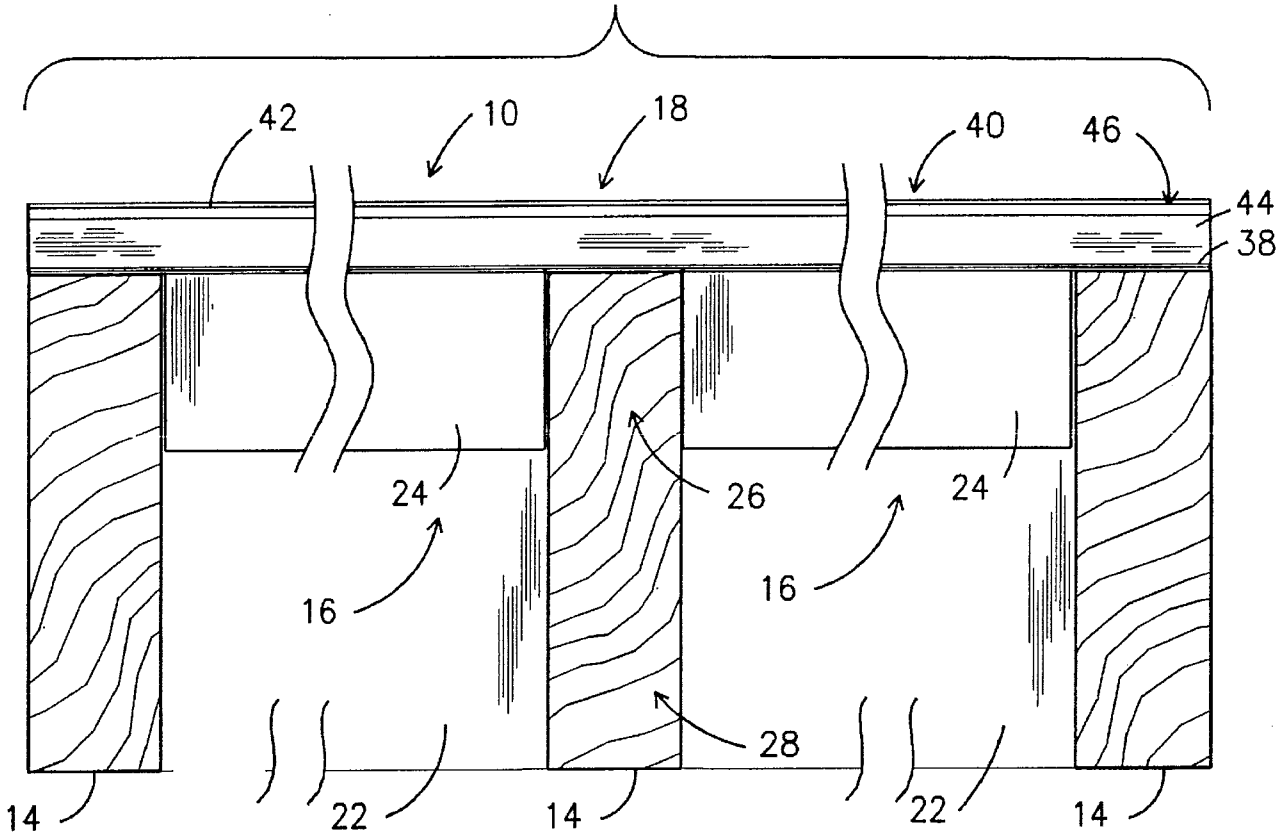
FIG. 2 is a side view of the elongated integral truss brace of the present invention operatively coupled to a plurality of lower truss tie bars.

As shown in FIGS. 1 through 4, the present invention relates to an elongated integral truss brace comprising a truss brace frame and a brace stiffener generally indicated as 10 to operatively engage opposite end portions 12 of each of a plurality of lower truss tie bars each indicated as 14 of a corresponding plurality of roof trusses (not shown) to retain the plurality of lower truss tie bars 14 and corresponding roof trusses (not shown) in space relationship relative to each other to reinforce the roof truss system formed by the plurality of roof trusses (not shown). Each elongated integral truss brace 10 comprises a pair of substantially parallel lower interrupted side panels each generally indicated as 16 held in fixed spaced relationship relative to each other by an upper elongated interconnecting member generally indicated as 18 to cooperatively form a stiffener channel 20 therebetween to receive and retain a plurality of rigid brace stiffeners, such as a 2×4 or 2×6 wood filler, each indicated as 22 therein.

Figure 1:
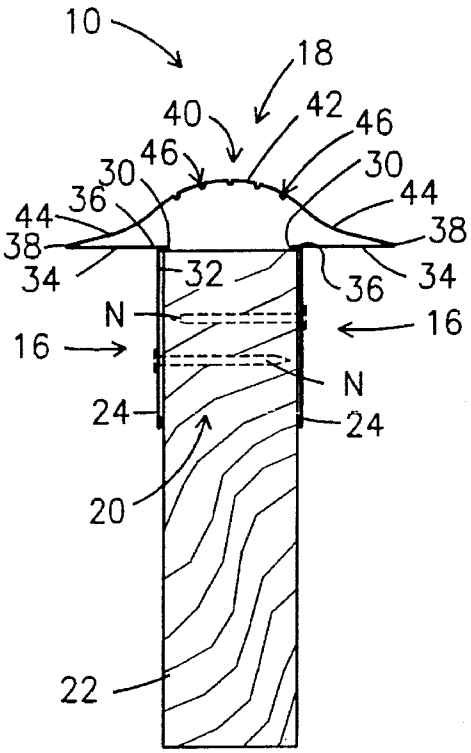
FIG. 1 is a cross-sectional end view of the elongated integral truss brace of the present invention.
Figure 3:
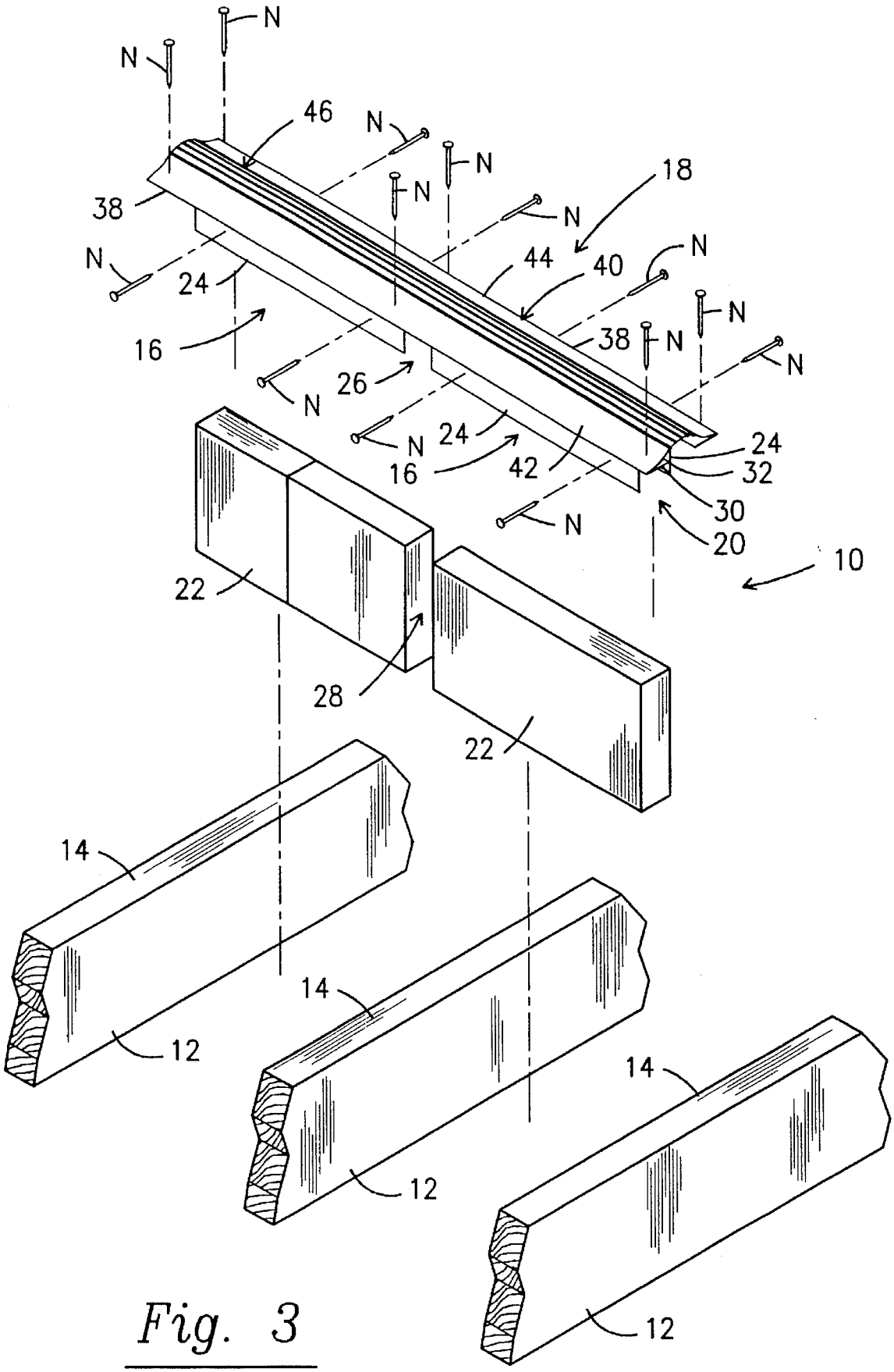
FIG. 3 is a perspective exploded view of the elongated integral truss brace of the present invention with a plurality of lower truss tie bars.
Figure 4:
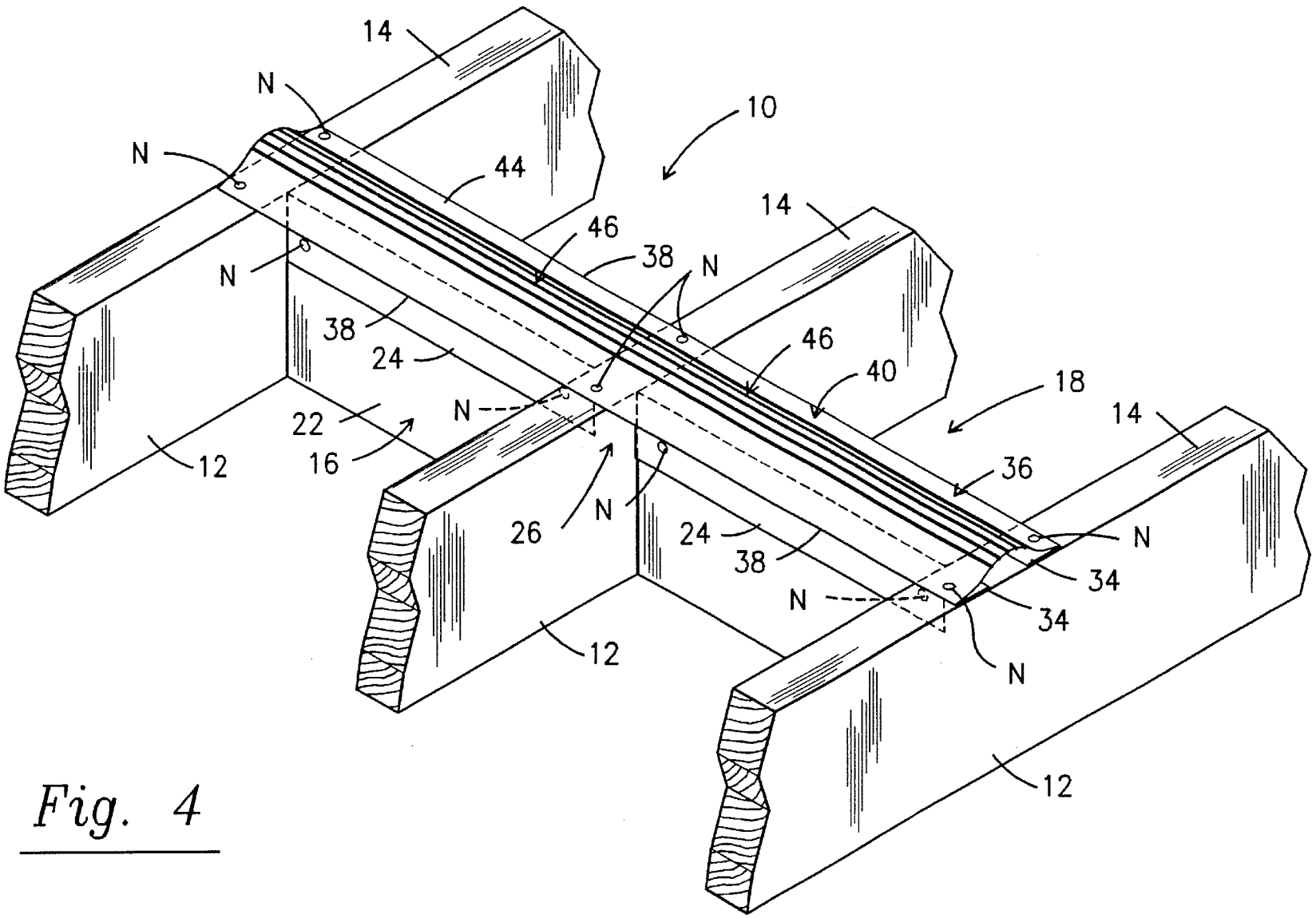
FIG. 4 is a perspective view of the elongated integral truss brace of the present invention coupled to a plurality of lower truss tie bars.

Each lower interrupted side panel 16 comprises a plurality of side panel sections each indicated as 24 disposed in spaced relationship relative to each other along the length of the upper interconnecting member 18 to cooperatively form a tie bar notch 26 between adjacent side panel section 24. As best seen in FIG. 2, the width of each rigid brace stiffener 22 is substantially equal to or less than the width of the corresponding side panel section 24 disposed on opposite sides of the stiffener channel 20 to cooperatively form a tie bar slot 28 between adjacent ridge brace stiffeners 22 to receive opposite end portions 12 of the lower truss tie bar 14. As best shown in FIGS. 1 and 3, a positioning means comprising a brace stiffener limit 30 extends inwardly from the inner surface 32 of each corresponding side panel section 24 into the stiffener channel 20 to limit the inward or upward movement of the brace stiffener 22 relative to the stiffener channel 20 to properly position each rigid brace stiffener 22 within the stiffener channel 20 and relative to the upper elongated interconnecting member 18.

The upper elongated interconnecting member 18 comprises a pair of elongated side plates each indicated as 34 connected at the inner edge 36 thereof adjacent the positioning means of the corresponding lower interrupted side panel 16 and interconnected to each other at the outer edges 38 thereof by an elongated center connecting element generally indicated as 40. The elongated center connecting element 40 comprises a convex mid portion 42 connected to the outer edges 38 of the elongated side plates 34 by a corresponding apron or skirt member 44 inclined relative to the corresponding elongated side plate 34. A plurality of grooves or ridges each indicated as 46 extend longitudinally along the elongated center connecting element 40 to form a brace strengthening means between corresponding side panel sections 24.

To assemble, the rigid brace stiffeners 22 are placed in the stiffener channel 20 to engage the positioning means 30 and secured in place between corresponding side panel sections 24 disposed on opposite sides of the stiffener channel 20 by nails N, glue or similar securing means thereby forming the plurality of tie bar slots 28.

To use, an assembled elongated integral truss brace 10 comprising the truss brace frame including the lower interrupted side panels 16 and the upper elongated interconnecting member 18 and the brace stiffener including the plurality of rigid brace stiffeners 22 is operatively positioned on opposite end portions 12 of the lower truss tie bars 14 by placing the lower truss tie bars 14 in corresponding tie bar slots 28. The elongated integrated truss brace 10 is then secured to the lower truss tie bars 14 by nails N or other suitable securing means extending through the elongated side plates 34 to brace and reinforce the plurality of roof trusses (not shown) of the roof truss system (not shown).

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An elongated integral truss brace comprising a truss brace frame and a brace stiffener to operatively engage opposite end portions of each of a plurality of lower truss tie bars of a corresponding plurality of roof trusses to retain the plurality of lower truss tie bars and corresponding roof trusses in space relationship relative to each other to reinforce the roof truss system formed by the plurality of roof trusses, said elongated integral truss brace comprises a pair of substantially parallel lower interrupted side panels held in fixed spaced relationship relative to each other by an upper elongated interconnecting member to cooperatively form a longitudinally disposed stiffener channel, each said lower interrupted side panel comprises a plurality of side panel sections disposed in spaced relationship to each other along the length of said upper interconnecting member to cooperatively form a tie bar notch between adjacent side panel sections to receive the lower truss tie bars therein, and a longitudinally disposed rigid brace stiffener disposed between corresponding side panel sections of each said lower interrupted side panels to strengthen said elongated integral truss brace.

2. The elongated integral truss brace of claim 1 wherein said upper elongated interconnecting member comprises a pair of elongated side plates interconnected by an elongated center connecting element.

3. The elongated integral truss brace of claim 2 wherein said elongated center connecting element comprises a convex mid portion connected to each of said elongated side plates by a corresponding skirt member inclined relative thereto.

4. The elongated integral truss brace of claim 3 wherein said convex mid portion further includes a strengthening means to stiffen said elongated integral truss brace.

5. The elongated integral truss brace of claim 4 wherein said strengthening means comprises at least one groove extending longitudinally along said elongated center connecting element.

6. The elongated integral truss brace of claim 4 wherein said strengthening means comprises at least one ridge extending longitudinally along said elongated center connecting element.

7. The elongated integral truss brace of claim 2 further including a positioning means to limit the inward movement of each said rigid brace stiffener relative to said stiffener channel to properly position each rigid brace stiffener within said stiffener channel.

8. The elongated integral truss brace of claim 7 wherein said positioning means comprises a brace stiffener limit extending inwardly from the inner surface of each said side panel section into said stiffener channel.

9. The elongated integral truss brace of claim 7 wherein said rigid brace stiffeners are secured in place between corresponding side panel sections disposed on opposite sides of said stiffener channel by a securing means.

10. The elongated integral truss brace of claim 1 secured to the lower truss tie bars by securing means connected to said elongated side plates.

11. An elongated integral truss brace comprising a truss brace frame and a brace stiffener to operatively engage opposite end portions of each of a plurality of lower truss tie bars of a corresponding plurality of roof trusses to retain the plurality of lower truss tie bars and corresponding roof trusses in space relationship relative to each other to reinforce the roof truss system formed by the plurality of roof trusses, said elongated integral truss brace comprises a pair of substantially parallel lower interrupted side panels held in fixed spaced relationship relative to each other by an upper elongated interconnecting member to cooperatively form a longitudinally disposed stiffener channel to receiver and retain a plurality of longitudinally disposed rigid brace stiffeners therein, each said lower interrupted side panel comprises a plurality of side panel sections disposed in spaced relationship relative to each other along the length of sail upper interconnection member to cooperatively form a tie bar notch between adjacent side panel sections to receive the lower truss tie bars therein, sail upper elongated interconnection member comprises a pair of elongated side plates interconnected by an elongated center connection element and said elongated center connecting element compreses a convex mid portion connected to each said elongated side plates by a corresponding skirt member inclined relative thereto.

12. The elongated integral truss brace of claim 11 wherein said convex mid portion further includes a strengthening means to stiffen said elongated integral truss brace.

13. The elongated integral truss brace of claim 12 wherein said strengthening means comprises at least one groove extending longitudinally along said elongated center connecting element.

14. The elongated integral truss brace of claim 12 wherein said strengthening means comprises at least one ridge extending longitudinally along said elongated center connecting element.

15. The elongated integral truss brace of claim 11 further including a positioning means to limit the inward movement of each said rigid brace stiffener relative to said stiffener channel to properly position each rigid brace stiffener within said stiffener channel.

16. The elongated integral truss brace of claim 15 wherein said positioning means comprises a brace stiffener limit extending inwardly from the inner surface of each side panel section into said stiffener channel.

17. The elongated integral truss brace of claim 15 wherein said rigid brace stiffeners are secured in place between corresponding side panel sections disposed on opposite sides of said stiffener channel by a securing means.

18. The elongated integral truss brace of claim 11 secured to the lower truss tie bars by securing means connected to said elongated side plates.

19. An elongated integral truss brace comprising a truss brace frame and a brace stiffener to operatively engage opposite end portions of each of a plurality of lower truss tie bars of a corresponding plurality of roof trusses to retain the plurality of lower truss tie bars and corresponding roof trusses in space relationship relative to each other to reinforce the roof truss system formed by the plurality of roof trusses, said elongated integral truss brace comprises a pair of substantially parallel lower interrupted side panels held in fixed spaced relationship relative to each other by an upper elongated interconnecting member to cooperatively form a longitudinally disposed stiffener channel to receive and retain a plurality of longitudinally disposed rigid brace stiffeners therein, each said lower interrupted side panel comprises a plurality of side panel sections disposed in spaced relationship relative to each other along the length of said upper interconnecting member to cooperatively form a tie bar notch between adjacent side panel sections to receive the lower truss tie bars therein, said upper elongated interconnecting member comprises a pair of elongated side plates interconnected by an elongated center connecting element and a positioning means to limit the inward movement of each said rigid brace stiffener relative to said stiffener channel to properly position each rigid brace stiffener within said stiffener channel, said positioning means comprises a brace stiffener limit extending inwardly from the inner surface of each side panel section into said stiffener channel.

20. The elongated integral truss brace of claim 19 wherein said elongated center connecting element comprises a convex mid portion connected to each of said elongated side plates by a corresponding skirt member inclined relative thereto.

21. The elongated integral truss brace of claim 20 wherein said convex mid portion further includes a strengthening means to stiffen said elongated integral truss brace.

22. The elongated integral truss brace of claim 21 wherein said strengthening means comprises at least one groove extending longitudinally along said elongated center connecting element.

23. The elongated integral truss brace of claim 21 wherein said strengthening means comprises at least one ridge extending longitudinally along said elongated center connecting element.

24. The elongated integral truss brace of claim 19 wherein said rigid brace stiffeners are secured in place between corresponding side panel sections disposed on opposite sides of said stiffener channel by a securing means.

25. The elongated integral truss brace of claim 19 is secured to the lower truss tie bars by securing means connected to said elongated side plates.

* * * * *